US007032501B2

(12) United States Patent
Boertje et al.

(10) Patent No.: US 7,032,501 B2
(45) Date of Patent: Apr. 25, 2006

(54) APPARATUS AND METHOD FOR PROVIDING A CLAMP ON A FLUID POWER CYLINDER

(75) Inventors: Marcus Boertje, Port Washington, NY (US); Ulrich Hirling, Denkendorf (DE)

(73) Assignee: Festo Corporation, Hauppauge, NY (US)

( * ) Notice: Subject to any disclaimer, the term of this patent is extended or adjusted under 35 U.S.C. 154(b) by 22 days.

(21) Appl. No.: 10/841,597

(22) Filed: May 7, 2004

(65) Prior Publication Data

US 2005/0247192 A1 Nov. 10, 2005

(51) Int. Cl.
*F01B 29/00* (2006.01)

(52) U.S. Cl. ..... 92/161

(58) Field of Classification Search ..... 92/161, 92/169.1

See application file for complete search history.

(56) References Cited

U.S. PATENT DOCUMENTS

| | | | | | |
|---|---|---|---|---|---|
| 975,784 | A | * | 11/1910 | Myer | 92/161 |
| 4,700,616 | A | * | 10/1987 | Stoll et al. | 92/161 |
| 5,237,909 | A | * | 8/1993 | Pirhadi | 92/161 |
| 5,725,195 | A | * | 3/1998 | Cotter | 248/659 |
| 6,007,034 | A | * | 12/1999 | Stoll et al. | 248/229.1 |

* cited by examiner

*Primary Examiner*—Thomas E. Lazo
(74) *Attorney, Agent, or Firm*—Hoffmann & Baron, LLP

(57) ABSTRACT

A fluid power cylinder provided with a clamp to allow for clamping of the cylinder to another surface, or for clamping of an object onto the cylinder housing without applying forces directly on an inner bore of the cylinder and without causing any distortion of the bore diameter surface of the cylinder in which a piston is running.

18 Claims, 5 Drawing Sheets

APPARATUS AND METHOD FOR PROVIDING A CLAMP ON A FLUID POWER CYLINDER

FIELD OF THE INVENTION

The invention relates to clamping devices for clamping on an exterior surface of a fluid power cylinder having a reciprocable piston member. More particularly, the invention relates to a clamp that provides a clamping force on the fluid power cylinder housing without applying pressure to and/or distorting the internal cylinder bore in which the piston reciprocates.

BACKGROUND OF INVENTION

Fluid operated or fluid power cylinders generally include a cylindrical shaped tube or barrel with a cylindrical inner bore in which a piston reciprocally moves in the longitudinal direction. Generally, the barrel of the fluid power cylinder is manufactured of metal, such as aluminum or stainless steel. More commonly, the cylinder barrel is of the conventional round architecture, i.e., a simple torus geometry. A second, more modern type of barrel used in fluid power cylinders includes a square profile made by extrusion of a metal material, such as aluminum. The architecture of the square extension usually includes a variety of complex geometrical patterns, ranging from a simple square or rectangular outer geometry with a round cavity in the middle to a very complex outer geometry with a complex internal geometry.

Fluid power cylinders are controlled by various sensors and switches designed to sense the position of a reciprocating piston within the cylinder. Through these sensors, the mechanisms controlling the action of the fluid power cylinders may determine the position of the piston, or the timing for opening or closing various valves, inlets, or outlets in order to control the fluid pressure working on the piston, and vice versa. Thus, in some applications of fluid power cylinders, and depending on the task to be accomplished, it is often necessary to mount sensors or electrical switches onto the cylinder housing in order to respond to a piston as it travels within the inner bore, or to control operation of the cylinder. The piston often contains some means to activate a sensing device or switch associated with the mounted sensor to help the sensor determine the position of the piston as it travels within the inner bore. Moreover, the fluid power cylinder is often in cooperative coupling with another apparatus or serves as part of a mechanism. The current methods of mounting or clamping sensors or other objects on the fluid power cylinder and the apparatus for achieving such clamping are quite varied.

In many fluid power cylinders, the barrel outer surface is used to clamp position sensors or other devices thereto. One method currently used to hold an object on a cylinder, including a sensor or apparatus, is the tie-rod method. Tie-rods are provided between the end caps and the object is either clamped on the rod or the tie rods are screwed into the object that needs to be held along the cylinder profile. While several variations of the tie-rod types of mounting systems exist in the prior art, most commonly, the cylinder is simply surrounded by tie rods which connect and hold various structures, such as caps or heads, at opposing ends of the cylinder and the tie rods serve as the structure upon which the clamping occurs and the sensors are mounted. The sensor may be held in place via metal or plastic tie-straps. Screw clamp methods are known in the art as well.

In tie-rod mounting systems, the clamp forces used for the placement of the sensors onto the barrel outer surface are rather low. Thus, it is unlikely that clamping of the sensor will distort the cylinder profile or the inner bore wherein the piston travels reciprocally.

However, tie-rod mounting systems present other potential problems. For example, when an object or the cylinder itself needs to be held in place along the barrel surface to avoid movement of the object or avoid movement of the cylinder, the mounting system may slip or pivot on the tie rod. Moreover, in order to properly install or change the clamp mounted with tie rods, one must disconnect the tie rods and remove the cylinder head.

More recent innovations aimed at alleviating the problems with tie rods often do not achieve the desired level of success, or simply trade one problem for another. For example, in U.S. Pat. No. 5,014,950, issued to Ohman et al., a clamping assembly for attaching a magnetically operated electrical switch to a tie rod and against the outside surface of a cylinder is disclosed. The stated goal of the invention is the creation of a clamping device which cooperates with an apparatus to hold that apparatus in a pre-determined position against the outside of a cylinder. Ohman et al. further discloses that the essence of the invention resides in the fact that the cooperating clamp surfaces engage the tie rod and converge toward the cylinder in order to effectively draw the assembly tightly against the outside cylinder surface as the fastening means are tightened. In sum, the '950 patent discloses a clamp construction designed to cause the entire clamp assembly to converge tightly and move against the cylinder wall.

While trying to solve a problem associated with clamping to a tie-rod, the '950 patent creates other potential disadvantages. For example, when clamping on a simple torus profile or square/rectangular extruded type profile, high forces directed towards the center of the profile may affect the housing material in such a way that the inner bore of the cylinder becomes smaller or distorted. As the diameter of the inner bore decreases in size or becomes distorted from its annular shape, the piston running inside the inner bore may bind or become stuck inside the inner bore due to higher friction. The higher friction will in turn cause wear on the piston running surface, which in most cases is a seal or seal with slide bearing combination. This additional wear will adversely affect the life expectancy of the cylinder. Furthermore, when the piston seal wears due to the profile distortion, small openings at the seal can form and the seal will not be able to properly seal. Thus, fluid tightness of the cylinder and piston will be lost. The additional friction will also cause the piston to run slower and the piston travel time to increase.

On the other hand, one may attempt to decrease the forces directed by the clamp on the inner bore by loosening the clamp around the perimeter of the fluid power cylinder; however, this can create other problems. For example, the reciprocal movement of the piston in the inner bore of the cylinder inherently generates high fluid power cylinder forces that may cause the clamped object to come lose. There is also the potential of moving the clamped object out of position due to accidentally hitting the object. This poses a potential hazard to a person standing nearby the object. Moreover, current clamp-on designs are non-smooth designs generally having sharp edges, which pose the threat of potential danger to a person handling such a component. The person may hurt himself or herself by the protruding components of the clamps.

Thus, there remains a need for an improved clamp assembly for securing an apparatus to the cylinder profile of a fluid power cylinder without using a tie rod and without distorting the inner bore of the cylinder or affecting the piston reciprocally traveling therein.

SUMMARY OF THE INVENTION

An object of the present invention is to provide a clamping method and a clamping apparatus that can be easily secured to the cylinder profile of a fluid power cylinder, without distorting the inner bore of the cylinder or negatively affecting the normal functioning of the piston reciprocally mounted therein.

It is a further object of the present invention to provide an improved clamping assembly to hold a switch, sensor, or some other object or apparatus on the cylinder profile of a fluid power cylinder, or to clamp the cylinder to some other structure in a proper orientation and location.

To attain the above-mentioned goals, the present invention provides a clamping device which cooperatively couples an implement or apparatus to the housing of a fluid power cylinder to hold that apparatus in a predetermined position against the outside surface of the cylinder. The clamping device may also hold the fluid power cylinder in a predetermined position relative to an apparatus. Thus, in the accompanying drawings, there is schematically depicted a hydraulic or fluid power cylinder and a clamping device attached to said cylinder. The cylinder comprises a body or housing which defines an outer cylinder profile including an outer geometry adapted to receive the clamp. The cylinder housing includes an annular inner bore. Mounted within the housing inner bore and slidably engaging the inner surface thereof is a piston which travels reciprocally therein.

Embodiments of the invention further satisfy the above-identified need in the art by providing a clamp method and profile geometry that will direct the forces generated by the securing means of the clamp in such a way that it will not distort the inner diameter of the inner bore of the cylinder barrel. More specifically, clamping forces are effectively directed away from the circumference of the inner bore by providing a cylinder barrel including at least one longitudinal groove specifically located along the barrel outer surface. The groove can have varying geometries and may have different angles, radii, or depth. However, regardless of the geometry, configuration, or orientation of the groove, the groove provides a load bearing surface upon which the clamp engages such that the clamping forces are directed away from the inner bore and the piston running reciprocally therein. In a preferred embodiment, a line of force created by the securing means for the clamp on the load bearing surface is generally parallel to a line tangential to a curve of the annular inner bore. Stated differently, the line of force generated by the securing means is such that it does not place any pressure upon the housing which could adversely affect or distort the inner bore of the housing. Directing the forces away from the inner bore helps maintain the efficiency of the cylinder assembly. Hence, the bore internal diameter will retain the same size and shape and not cause the piston to bind, get stuck or have additional wear at the piston seal.

In order to be efficiently manufactured, the clamp in accordance with the present invention may be made in one piece or several pieces depending upon the application. The clamp may be designed to completely encircle the cylinder housing or, alternatively, may be designed to clamp to a corner or edge of the housing. Moreover, the clamped object can be assembled and disassembled without having to disassemble the cylinder or change the cylinder structure in any way, saving assembly cost. The design of the present invention does not require additional tie-rods and generally requires less torque due to the novel securing means comprising a set screw and block, the block including a large surface area for contacting the load bearing surface of the cylinder groove.

A preferred form of the present invention, as well as other embodiments, features and advantages of this invention, will be apparent from the following detailed description of illustrative embodiments thereof, which is to be read in connection with the accompanying drawings.

DETAILED DESCRIPTION OF THE PREFERRED EMBODIMENTS

Figure 1:
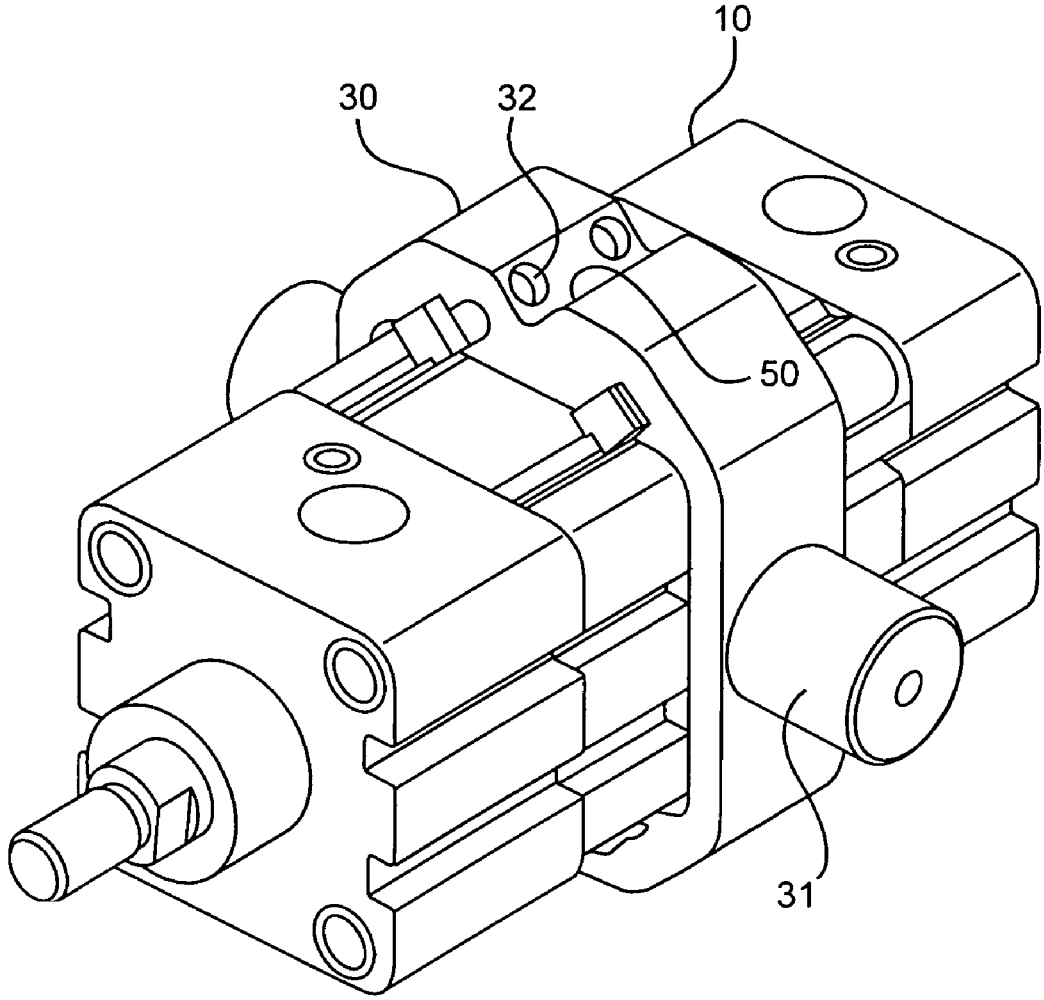
FIG. 1 illustrates a side perspective view of a first clamping assembly attached to a fluid power cylinder housing.
Figure 2:
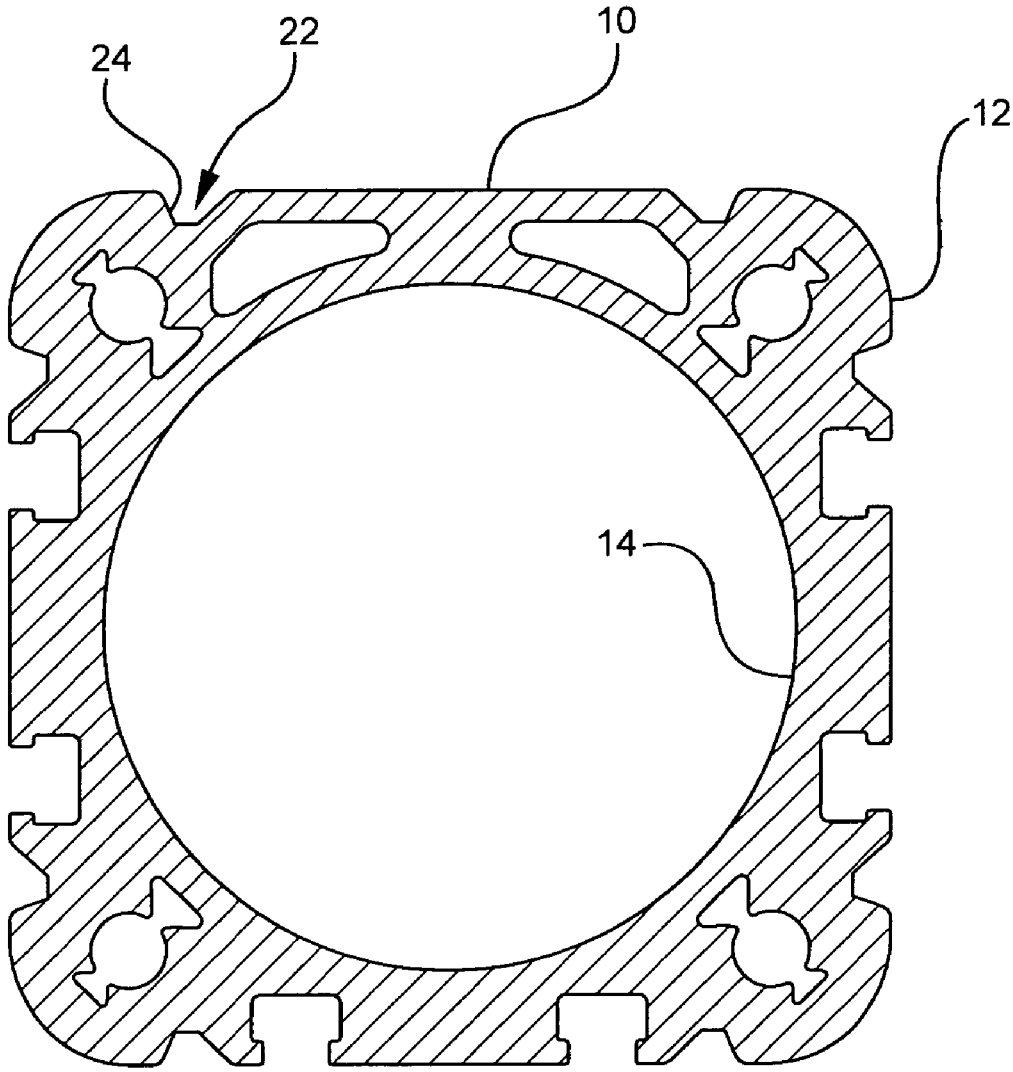
FIG. 2 illustrates a cross-sectional view of a preferred cylinder profile of the barrel of the fluid power cylinder.
Figure 3:
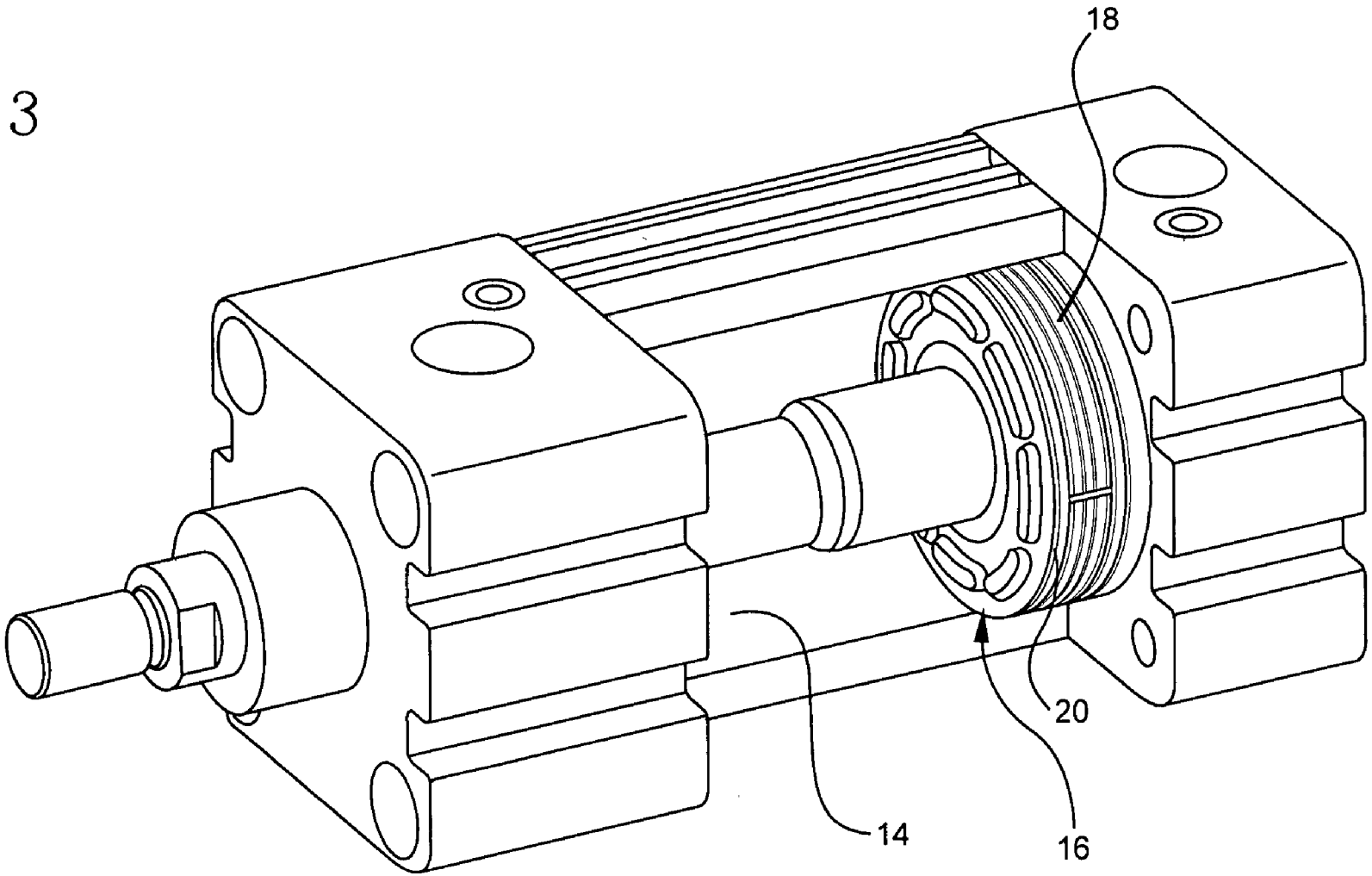
FIG. 3 is a partial cut-away of longitudinal perspective view of a fluid power cylinder including housing grooves.

The present invention provides a movable clamping apparatus designed to operate in combination with a fluid power cylinder, such as a pneumatic or hydraulic cylinder. For purposes of illustrating the invention, the figures show a pneumatic device; however, those skilled in the art will appreciate that the invention can be used on any fluid power device. With reference to FIG. 1 of the drawings, the principal components of the combination include a fluid power cylinder 10 and a clamp 30 mounted to said fluid power cylinder 10. As shown in FIGS. 2 and 3, the fluid power cylinder 10 comprises a housing having an outer cylinder profile 12 and an inner annular bore 14 adapted to receive a piston 16 reciprocally movable therein, the piston including a piston bearing 18 and piston seal 20. Alternatively, the cylinder to which the clamp is to be connected may be a magnetically coupled rodless cylinder which is well known to those skilled in the art. In the case of a magnetically coupled rodless cylinder, the clamp of the present invention may be mounted to the carriage or follower housing. Similarly, the cylinder may be driven by either air or by some other fluid, such as hydraulic fluid. As depicted in FIG. 2, the cylinder housing has an outer cylinder profile 12 which includes an outer geometry adapted to receive the clamp 30, the cylinder profile 12 outer geometry includes at least one elongated mounting groove 22 extending along the longitudinal axis of the cylinder housing. The elongated groove includes a load bearing surface 24 for attachment of the clamp thereto. The groove is preferably specifically located between a mid-point of the side and a corner thereof as shown in FIG. 1. It will be appreciated by those skilled in the art that the groove must be placed on the cylinder housing so that pressure applied to the load bearing surface will generally not apply pressure to the housing inner bore.

Figure 4:
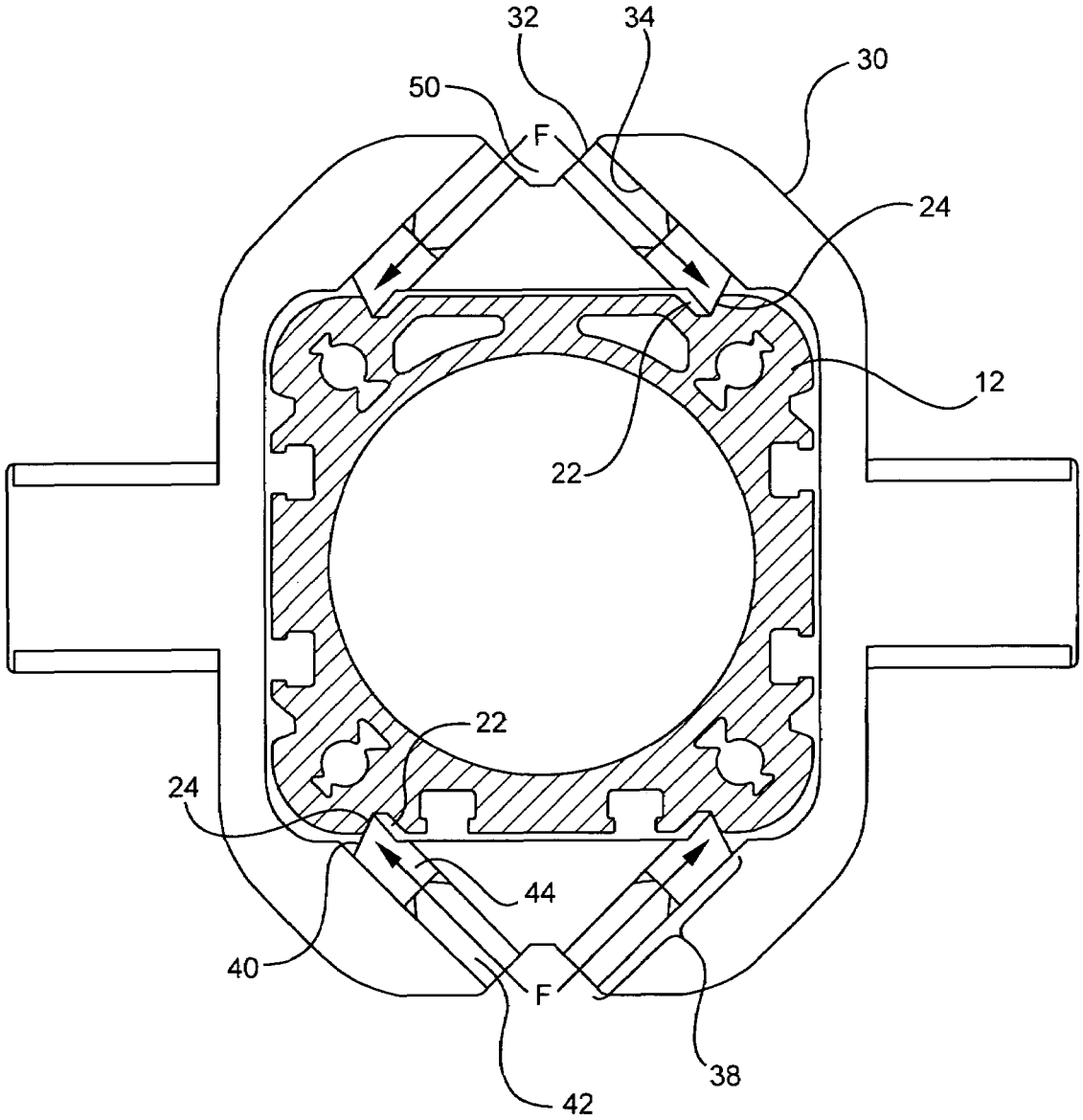
FIG. 4 is a cross-sectional view of the clamping assembly attached to a cylinder profile of the barrel of the fluid power cylinder as shown in FIG. 1.

The elongated groove in the housing may be of any geometry, but is preferably generally v-shaped for ease of manufacturing the extruded housing. Furthermore, the groove is located on the cylinder housing such that upon applying pressure to the load bearing surface, substantially no force is applied to the inner bore of the housing. As shown in FIG. 1, the housing includes at least one groove located between a side surface mid-point and an edge thereof. As shown in FIG. 4, the cylinder housing preferably includes two grooves on each of the four sides of the cylinder housing.

Figure 5:
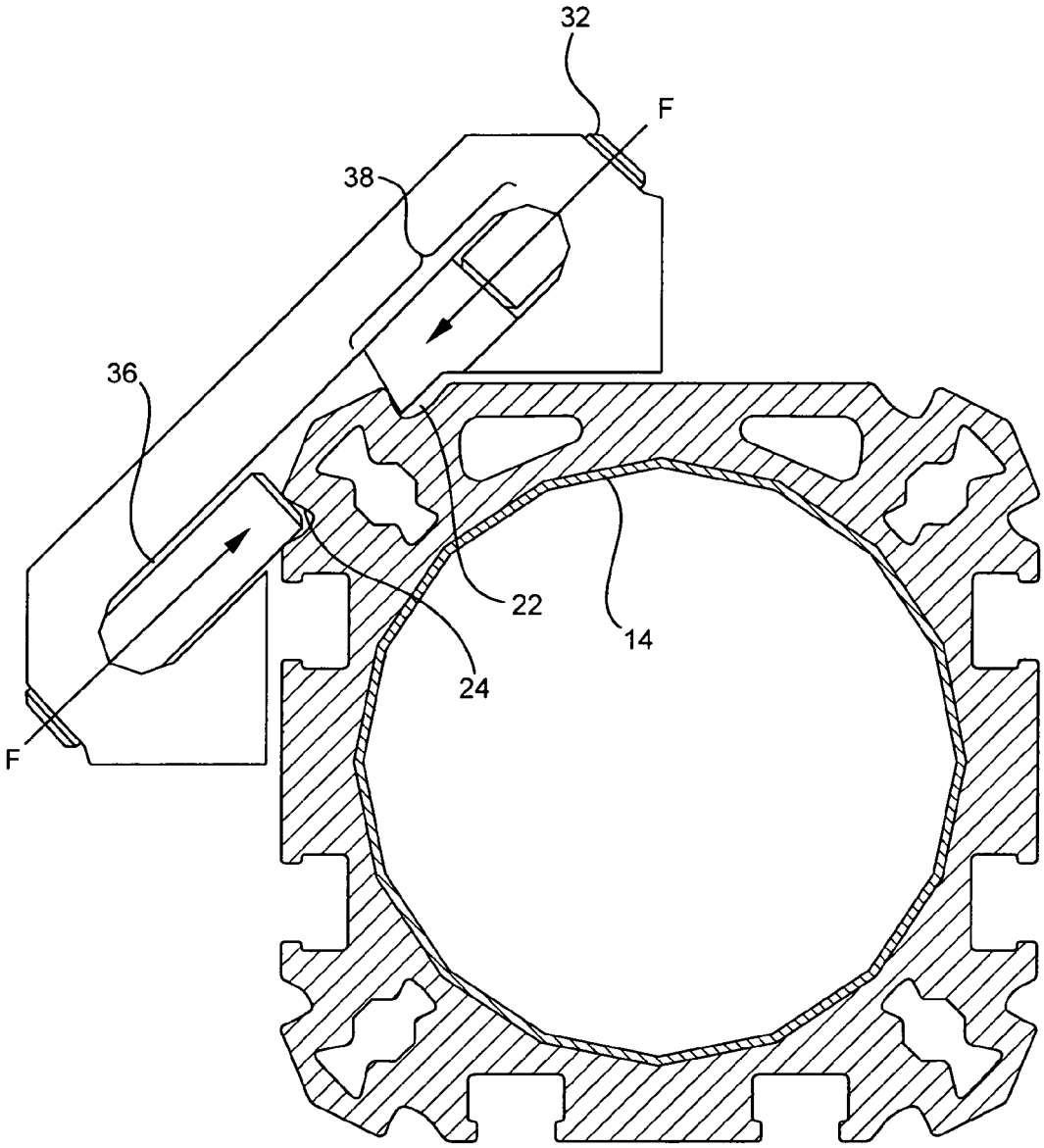
FIG. 5 is a cross-sectional view of a second clamping assembly attached to a fluid power cylinder housing.

As shown in FIG. 1 the clamp 30 may comprise a housing which substantially surrounds the cylinder profile 12. The clamp 30 may also include a trunnion 31 so that the fluid power cylinder may be mounted to another device. Alternatively, as shown in FIG. 5, the clamp 30 may comprise a housing which does not surround the cylinder profile but rather attaches to any corner of the cylinder profile 12 utilizing the mounting grooves 22 on adjacent side surfaces of the cylinder profile. Irrespective of the particular shape, the clamp housing includes at least one securing means 32 for securing the clamp 30 to a mounting groove on the cylinder profile 12. Two alternative designs for a securing means are shown in FIG. 5. Preferably, the securing means 32 comprises a threaded locking screw 36 which is mounted within a threaded bore 34 of the clamp. The locking screw 36 has an end surface which engages the load bearing surface 24 of the mounting groove 22 to retain the clamp securely to the cylinder housing. The locking screw end surface may include grooves, knurling, or a roughened surface of any kind to provide additional friction against the load bearing surface to enhance the clamping action.

Alternatively, as depicted in FIGS. 4 and 5, the securing means 32 for securing the clamp 30 to the cylinder housing may comprise at least one threaded bore 34 in the clamp adapted to receive a cooperating threaded locking device 38 including a locking screw 42 and a securing block or engagement member 44. The securing block 44 may be formed of a material having a greater coefficient of friction than the locking screw to enhance the securement of the clamp 30 to the cylinder housing. Furthermore, the securing block may include an end surface with a surface area larger than that of the aforementioned locking screw 42 to provide greater holding force for the clamp 30. The securing block 44 may also include a roughened end surface 40. The roughened end surface 40 may be a knurled surface for engaging the load bearing surface 24 of said groove 22 or any other roughened end surface which would enhance the gripping force of the securing block to the load bearing surface. While two alternative designs for the securing means are shown in FIG. 5, it will be appreciated by those skilled in the art that any securing means for securing the clamp on the cylinder profile whereby the securing means engages the load bearing surface of the groove falls within the scope of the present invention. Some alternative designs include, but are not limited to, clips, spring-loaded fasteners, fasteners having a cooperative rib and groove design, and the like.

The clamp 30 shown in FIGS. 1 and 4 also preferably includes at least one channel or groove 50 on an outer surface of said clamp 30 in which said securing means 32 is mounted. Specifically, the securing means 32 is provided in a wall of the groove to provide easy access to the securing means 32 for attaching the clamp 30 to the cylinder housing. As shown in FIG. 4, the channel or groove 50 on the outer surface of said clamp 30 is preferably substantially v-shaped, but may be any geometry which permits easy access to the securing means for the clamp.

As shown in FIGS. 4 and 5, the configuration of the securing means 32 of the clamp 30 provides that the clamping forces applied to the load bearing surface 24 of the groove 22 are directed away from the axial bore 14 in which the piston reciprocates. More specifically, the configuration of the present invention provides that the clamping forces shown by arrows F in FIGS. 4 and 5, be applied in a direction which is substantially parallel to a line tangential to a curve of the inner bore 14. It will be appreciated by those skilled in the art that any clamp mounting system whereby the forces applied to secure the clamp to a cylinder housing are directed so as not to put pressure on or distort the axial bore within the cylinder housing falls within the scope of the present invention. Thus, as provided in the embodiments disclosed herein, directing the clamping forces away from the inner bore 14 prevents the inner bore 14 from distorting and helps to avoid the occurrence of the piston 16 binding or having additional wear on the piston bearing 18 and/or piston seal 20.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. In combination:

a fluid power cylinder and a clamp mounted to said fluid power cylinder, wherein said fluid power cylinder comprises a housing having an outer cylinder profile and an inner annular bore adapted to receive a piston reciprocally movable therein, the outer cylinder profile including an outer geometry adapted to receive the clamp, the cylinder profile outer geometry including at least one substantially v-shaped groove therein, said groove having a load bearing surface; and wherein said clamp comprises a housing including at least one means for securing the clamp to the cylinder profile whereby the securing means engages the load bearing surface of said groove such that a force applied by said securing means to said load bearing surface is generally parallel to a line tangential to a curve of said cylinder inner bore to avoid distortion of said cylinder inner bore.

2. A combination of a fluid power cylinder and a clamp mounted to said fluid power cylinder as defined in claim 1, wherein said securing means comprises at least one threaded bore adapted to receive a cooperating threaded locking device having a roughened end surface to engage the load bearing surface of said groove.

3. A combination of a fluid power cylinder and a clamp mounted to said fluid power cylinder as defined in claim 2, wherein the locking device comprises a threaded screw and an engagement member.

4. A combination of a fluid power cylinder and a clamp mounted to said fluid power cylinder as defined in claim 2, wherein said roughened end surface includes a knurled surface for engaging the load bearing surface of said groove.

5. A combination of a fluid power cylinder and a clamp mounted to said fluid power cylinder as defined in claim 1, wherein the clamp substantially surrounds the cylinder housing.

6. A combination of a fluid power cylinder and a clamp mounted to said fluid power cylinder as defined in claim 5, wherein the clamp includes a trunnion.

7. In combination:

a fluid power cylinder and a clamp mounted to said fluid power cylinder, wherein said fluid power cylinder comprises a housing having an outer cylinder profile and an inner annular bore adapted to receive a piston reciprocally movable therein, the outer cylinder profile including an outer geometry adapted to receive the clamp, the cylinder profile outer geometry including at least one groove therein, said groove having a load bearing surface; and wherein said clamp comprises a housing including at least one means for securing the clamp to the cylinder profile whereby the securing means engages the load bearing surface of said groove such that a force applied by said securing means to said load bearing surface is generally parallel to a line tangential to a curve of said cylinder inner bore to avoid distortion of said cylinder inner bore and further wherein said securing means of said clamp comprises at least one threaded bore adapted to receive a threaded locking screw having an end surface which engages the load bearing surface of said groove.

8. A combination of a fluid power cylinder and a clamp mounted to said fluid power cylinder as defined in claim 7 wherein said at least one groove comprises any geometry.

9. In combination:

a fluid power cylinder and a clamp mounted to said fluid power cylinder, wherein said fluid power cylinder comprises a housing having an outer cylinder profile and an inner annular bore adapted to receive a piston reciprocally movable therein, the outer cylinder profile including an outer geometry adapted to receive the clamp, the cylinder profile outer geometry including at least one groove therein, said groove having a load bearing surface; and wherein said clamp comprises a housing including at least one means for securing the clamp to the cylinder profile whereby the securing means engages the load bearing surface of said groove such that a force applied by said securing means to said load bearing surface is generally parallel to a line tangential to a curve of said cylinder inner bore to avoid distortion of said cylinder inner bore and wherein said clamp further comprises at least one channel on outer surface of said clamp in which said securing means is mounted to provide access to the securing means.

10. A combination of a fluid power cylinder and a clamp mounted to said fluid power cylinder as defined in claim 9, wherein said at least one channel on outer surface of said clamp is substantially v-shaped.

11. A method for clamping a clamp on a cylinder profile of a fluid power cylinder, wherein the cylinder includes a substantially annular internal bore adapted to receive a piston reciprocally movable therein, the cylinder profile including an outer geometry adapted to receive the clamp, the method comprising:

providing at least one substantially v-shaped groove in said cylinder profile outer geometry, said groove including a load bearing surface;

providing a clamp including at least one means for securing the clamp to the cylinder profile whereby the securing means engages the load bearing surface of said groove such that a force applied by said securing means to said load bearing surface is generally parallel to a line tangential to a curve of said annular inner bore to avoid distortion of said cylinder inner bore.

12. A method for clamping a clamp on a cylinder profile of a fluid power cylinder as defined in claim 11, wherein said securing means comprises at least one threaded bore adapted to receive a cooperating threaded locking device having a roughened end surface to engage the load bearing surface of said groove.

13. A method for clamping a clamp on a cylinder profile of a fluid power cylinder as defined in claim 12, wherein said roughened end surface includes a knurled surface.

14. A method for clamping a clamp on a cylinder profile of a fluid power cylinder as defined in claim 11, wherein said clamp further comprises at least one channel on outer surface of said clamp in which said securing means is mounted.

15. A method for clamping a clamp on a cylinder profile of a fluid power cylinder as defined in claim 14, wherein said at least one channel on outer surface of said clamp is substantially v-shaped.

16. A method for clamping a clamp on a cylinder profile of a fluid power cylinder, wherein the cylinder includes a substantially annular internal bore adapted to receive a piston reciprocally movable therein, the cylinder profile including an outer geometry adapted to receive the clamp, the method comprising:

providing at least one groove in said cylinder profile outer geometry, said groove including a load bearing surface;

providing a clamp including at least one means for securing the clamp to the cylinder profile, wherein said securing means of said clamp comprises at least one threaded bore adapted to receive a threaded locking screw, whereby the locking screw engages the load bearing surface of said groove such that a force applied by said securing means to said load bearing surface is generally parallel to a line tangential to a curve of said annular inner bore to avoid distortion of said cylinder inner bore.

17. A method for clamping a clamp on a cylinder profile of a fluid power cylinder as defined in claim 16, wherein said at least one groove comprises any geometry.

18. In combination:

a fluid power cylinder including a housing having an external surface and an inner bore adapted to receive a piston reciprocally movable therein, the external surface of said housing including at least one substantially v-shaped groove, the groove having a load bearing surface; and a clamp comprising a housing including at least one securing means provided therein for securing the clamp to the fluid power cylinder housing external surface, wherein the securing means is adapted to engage the load bearing surface of the at least one groove such that a force applied by said securing means to said load bearing surface is imparted to said cylinder housing in a direction away from said cylinder inner bore to prevent distortion thereof.

* * * * *